US006112478A

United States Patent [19]

Piper

[11] Patent Number: 6,112,478

[45] Date of Patent: Sep. 5, 2000

[54] CAR SHIELD

[76] Inventor: Curt Piper, 27032 Columbia CT, Hayward, Calif. 94542

[21] Appl. No.: 08/997,931

[22] Filed: Dec. 24, 1997

[51] Int. Cl.[7] ..... E04D 13/18

[52] U.S. Cl. ..... 52/173.1; 52/39; 52/174; 160/330

[58] Field of Search ..... 52/39, 173.1, 174; 24/265 BC, 265 EC, 588, 598.4, 604; 160/330, 214

[56] References Cited

U.S. PATENT DOCUMENTS

| | | | |
|---|---|---|---|
| 1,742,209 | 1/1930 | Kuhnla | 52/39 |
| 4,010,933 | 3/1977 | Hebda | 256/23 |
| 4,014,583 | 3/1977 | Forbes | 293/62 |
| 4,561,685 | 12/1985 | Fischer | 293/128 |
| 4,571,903 | 2/1986 | Strassner | 52/173.1 |
| 4,643,471 | 2/1987 | Fishback | 293/128 |
| 4,825,515 | 5/1989 | Wolterstorff | 24/625 |
| 5,584,105 | 12/1996 | Krauss | 24/614 |
| 5,778,498 | 7/1998 | Lakas | 24/625 |

*Primary Examiner*—Carl D. Friedman
*Assistant Examiner*—C. Min Choe

[57] ABSTRACT

A protective divider for protecting adjacent vehicles is provided including a divider and a suspensions mechanism coupled between the divider and a ceiling of a garage such that the divider resides between doors of two vehicles situated within the garage.

5 Claims, 2 Drawing Sheets

26

28
10
3
12
14

26

28
32
4
18
12
18
4

CAR SHIELD

BACKGROUND OF THE INVENTION

1. Field of the Invention

The present invention relates to vehicular door guards and more particularly pertains to a new car shield for preventing damage to a vehicle door inflicted by the door of another vehicle parked adjacent thereto in a garage.

2. Description of the Prior Art

The use of vehicular door guards is known in the prior art. More specifically, vehicular door guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art vehicular door guards include U.S. Pat. No. 4,639,027; U.S. Pat. No. 4,707,009; U.S. Pat. Des. 312,237; U.S. Pat. No. 4,643,471; U.S. Pat. No. 5,129,695; and U.S. Pat. No. 5,209,545.

In these respects, the car shield according to the present invention substantially departs from the conventional concepts and designs of the prior art, and in so doing provides an apparatus primarily developed for the purpose of preventing damage to a vehicle door inflicted by the door of another vehicle parked adjacent thereto in a garage.

In view of the foregoing disadvantages inherent in the known types of vehicular door guards now present in the prior art, the present invention provides a new car shield construction wherein the same can be utilized for preventing damage to a vehicle door inflicted by the door of another vehicle parked adjacent thereto in a garage.

The general purpose of the present invention, which will be described subsequently in greater detail, is to provide a new car shield apparatus and method which has many of the advantages of the vehicular door guards mentioned heretofore and many novel features that result in a new car shield which is not anticipated, rendered obvious, suggested, or even implied by any of the prior art vehicular door guards, either alone or in any combination thereof.

To attain this, the present invention generally comprises a divider housing having a rectangular configuration and constructed from a woven fabric. The divider is provided having a pair of side faces and a periphery formed therebetween defining an interior space. The periphery is formed of an elongated top and bottom face and a pair of short side faces. As shown in FIG. 4, one of the side faces has a zipper positioned thereon along a length thereof for allowing access to the interior space. Next provided is a foam pad situated within the divider housing. A pair of couples are mounted to opposite ends of the elongated strip and extend upwardly therefrom. Mounted to a ceiling of a garage is a pulley. Such pulley is situated at a central extent of the ceiling of the garage. As shown in FIGS. 1 & 2, a first cable has a pair of quick release coupling mechanisms connected to ends thereof. The first cable is strung through the pulley such that the ends thereof are removably coupled to the couples. By this structure, the divider housing is situated between doors of two vehicles situated within the garage. Associated therewith is a second cable having a pair of quick release coupling mechanisms connected to ends thereof. The second cable has a first end removably coupled to a couple mounted to a central extent of an interior surface of a garage door. A second end is removably coupled to a closest one of the couples. As such, the garage door is adapted to slide upward such that the garage door is in coplanar relationship with the ceiling of the garage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new car shield apparatus and method which has many of the advantages of the vehicular door guards mentioned heretofore and many novel features that result in a new car shield which is not anticipated, rendered obvious, suggested, or even implied by any of the prior art vehicular door guards, either alone or in any combination thereof.

It is another object of the present invention to provide a new car shield which may be easily and efficiently manufactured and marketed.

It is a further object of the present invention to provide a new car shield which is of a durable and reliable construction.

An even further object of the present invention is to provide a new car shield which is susceptible of a low cost of manufacture with regard to both materials and labor, and which accordingly is then susceptible of low prices of sale to the consuming public, thereby making such car shield economically available to the buying public.

Still yet another object of the present invention is to provide a new car shield which provides in the apparatuses and methods of the prior art some of the advantages thereof, while simultaneously overcoming some of the disadvantages normally associated therewith.

Still another object of the present invention is to provide a new car shield for preventing damage to a vehicle door inflicted by the door of another vehicle parked adjacent thereto in a garage.

Even still another object of the present invention is to provide a new car shield that includes a divider and a suspensions mechanism coupled between the divider and a ceiling of a garage such that the divider resides between doors of two vehicles situated within the garage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
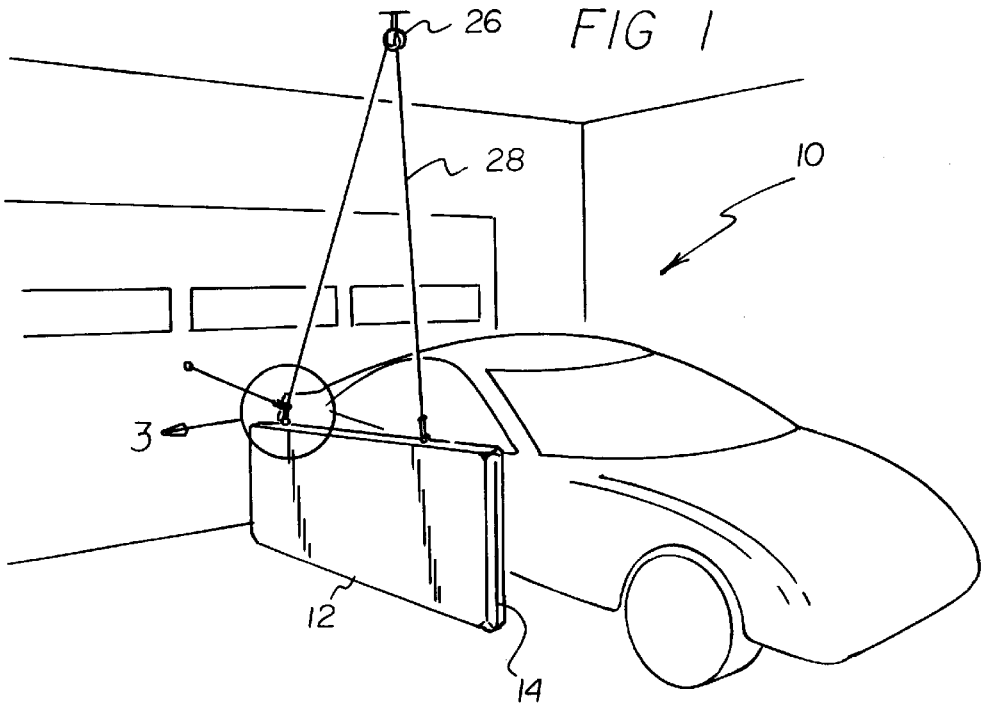
FIG. 1 is a perspective view of a new car shield according to the present invention.

With reference now to the drawings, and in particular to FIGS. 1 through 4 thereof, a new car shield embodying the principles and concepts of the present invention and generally designated by the reference numeral 10 will be described.

Figure 4:
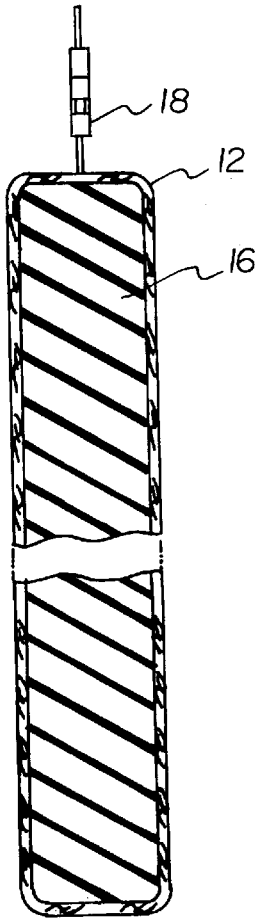
FIG. 4 is a cross-sectional view of the present invention taken along line 4—4 shown in FIG. 2.

The present invention, as designated as numeral 10, includes a divider housing 12 having a rectangular configuration and constructed from a woven fabric or nylon. The divider is provided having a pair of side faces and a periphery formed therebetween defining an interior space. The periphery is formed of an elongated top and bottom face and a pair of short side faces. As shown in FIG. 4, one of the side faces has a zipper 14 positioned thereon along a length thereof for allowing access to the interior space.

Figure 3:
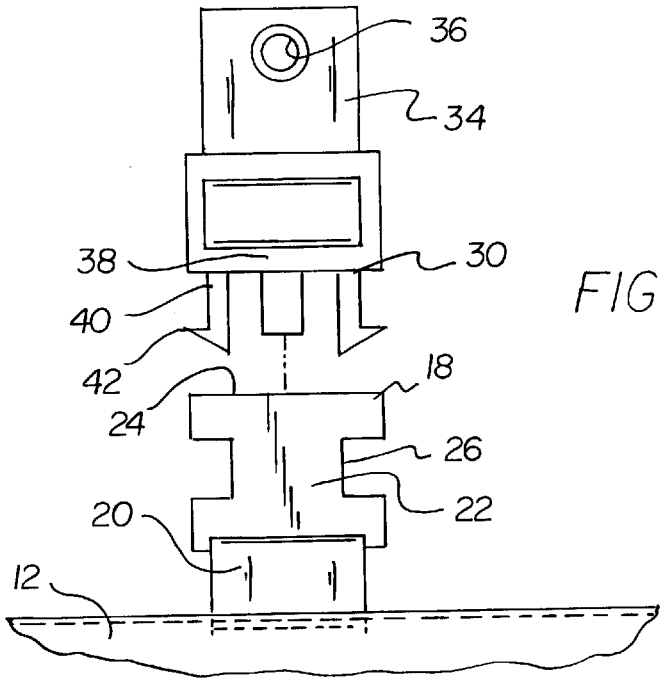
FIG. 3 is a perspective view of one of the male coupling mechanisms of the present invention.

Next provided is a foam pad 16 situated within the divider housing. The top face of the divider housing is equipped with a pair of female couples 18 each mounted adjacent to a respect side face of the divider housing. As shown in FIG. 3, each female couple includes a flexible strap 20 stitchedly coupled to the top face of the divider housing. Coupled thereto is a hollow plastic member 22 with an open top 24 and a pair of side openings 25. Mounted to a ceiling of a garage is a pulley 26. Such pulley is situated at a central extent of the ceiling.

Figure 2:
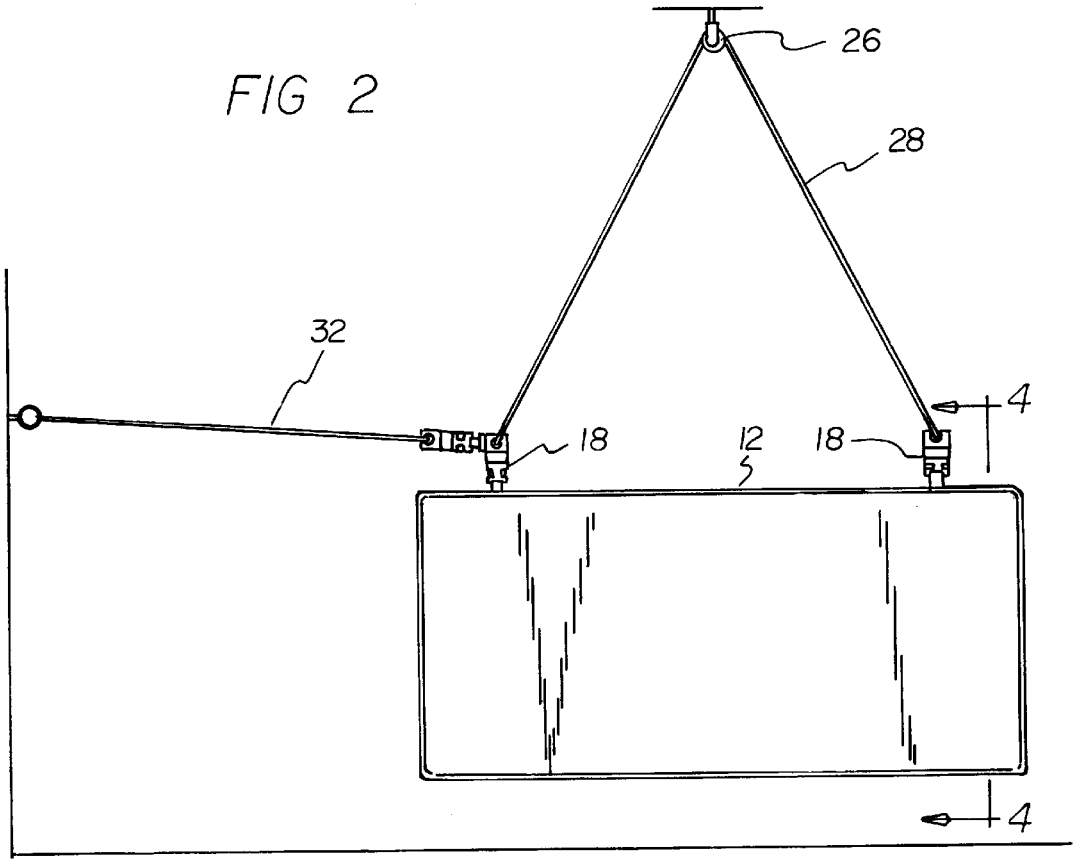
FIG. 2 is a side view of the present invention.

As shown in FIGS. 1 & 2, a first cable 28 has a pair of quick release male coupling mechanisms 30 connected to ends thereof. The first cable is strung through the pulley such that the ends thereof are removably coupled to the female couples. By this structure, the divider housing is situated between doors of two vehicles situated within the garage.

Associated therewith is a second cable 32 having a pair of male quick release coupling mechanisms connected to ends thereof. The second cable has a first end removably coupled to a female couple mounted to a central extent of an interior surface of a garage door. A second end is removably coupled to a closest one of the female couples of the divider housing. It should be noted that the garage door is adapted to slide upward to a position where the garage door is in coplanar relationship with the ceiling of the garage.

As shown in FIG. 3, the quick release male coupling mechanisms are provided each including a flexible tab 34 having a brass-reinforced eyelet 36 formed therein for coupling with an end of the associated cable. A plastic portion 38 is hingably coupled to the flexible tab with a pair of flexible prongs 40 each having a triangular protrusion 42 mounted on an exterior end thereof. During use, the male coupling mechanisms are each inserted within the associated female couple such that the protrusions are releasably situated within the side openings of the female couple.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective divider system for protecting adjacent vehicles comprising, in combination garage having a ceiling and door:

a divider housing having a rectangular configuration and constructed from a woven fabric, the divider having a pair of large side faces and a periphery formed therebetween defining an interior space with the periphery forming an elongated top and bottom face and a pair of short side faces, one of the short side faces having a zipper positioned thereon along a length thereof for allowing access to the interior space;

a foam pad situated within the divider housing;

a pair of female couples mounted to the top face of the divider housing adjacent opposite short side faces thereof, each female couple including a flexible strap stitchedly coupled to the top face of the housing and a hollow plastic member with an open top and a pair of side openings;

a pulley mounted to a ceiling of a garage at a central extent thereof;

a first cable for suspending the divider housing between doors of two vehicles situated within the garage, the first cable having a pair of quick release male coupling mechanisms connected to ends thereof, the first cable having the ends thereof removably coupled to the female couples, the first cable being strung through the pulley in a manner permitting free movement of the cable therethrough for allowing the divider housing to be easily positioned in a level orientation; and a second cable having a first end removably coupled to an eyelet couple mounted to a central extent of an interior surface of a garage door and a second end with a male coupling mechanism removably coupled to a female coupling mechanism connected to one of the short side faces of the divider adjacent to the top face thereof, whereby the garage door is adapted to slide upward such that the garage door is in coplanar relationship with the ceiling of the garage;

said quick release male coupling mechanisms each including a flexible tab having an eyelet formed therein, a plastic portion hingably coupled to the flexible tab with a pair of flexible prongs each having a substantially triangular protrusion mounted on an end thereof.

2. A protective divider system adapted for protecting adjacent vehicles within a garage, the divider system comprising:

a divider means;

a pulley mounted to a ceiling of the garage;

a first cable strung through the pulley such that ends thereof are coupled to opposite ends of the divider means, whereby the divider means resides between doors of two vehicles situated within the garage; and a second cable with a first end coupled to an interior surface of a center of a garage door of the garage and a second end coupled to the divider means, whereby the garage door is adapted to slide upward such that the garage door is in coplanar relationship with a ceiling of the garage.

3. A protective divider for protecting adjacent vehicles as set forth in claim 2 wherein a pair of quick release coupling mechanisms are connected to the ends of the cable and the cable is removably coupled to the divider system means.

4. A protective system for protecting adjacent vehicles as set forth in claim 2 wherein the divider means includes a flexible material.

5. A protective system for protecting adjacent vehicles as set forth in claim 2 wherein the divider means includes a fabric enclosure with a foam pad situated therein.

* * * * *